United States Patent [19]

Krieger

[11] 3,964,891

[45] June 22, 1976

[54] PROCESS AND ARRANGEMENT FOR COOLING FLUIDS

[76] Inventor: Heinrich Krieger, Leitlestrasse 16, 81 Garmisch-Partenkirchen, Germany

[22] Filed: Apr. 11, 1975

[21] Appl. No.: 567,407

Related U.S. Application Data

[63] Continuation of Ser. No. 392,810, Aug. 29, 1973, abandoned.

[30] Foreign Application Priority Data

Sept. 1, 1972 Germany ..... 2242998

[52] U.S. Cl. ..... 62/9; 62/40; 62/335; 62/510

[51] Int. Cl.[2] ..... F25J 1/02

[58] Field of Search ..... 62/9, 11, 40, 335, 114, 62/510

[56] References Cited

UNITED STATES PATENTS 3,596,472 8/1971 Streich ..... 62/40

FOREIGN PATENTS OR APPLICATIONS 110,556 2/1961 Pakistan ..... 62/40

110,539 1/1961 Pakistan ..... 62/40

*Primary Examiner*—Norman Yudkoff

*Assistant Examiner*—C. P. Ribando

*Attorney, Agent, or Firm*—Michael J. Striker

[57] ABSTRACT

A process for liquefying gaseous substances is disclosed wherein a first fluid to be liquefied is conveyed along a first path including a portion in which it is cooled. A cooling fluid is conveyed along a second path including a first section in which it is cooled, a second section in which it exchanges heat with the first fluid so as to cool the latter, and a third section thermally separated from the aforementioned first section of the second path. A precooling fluid is conveyed along a third path including a first part also thermally separated from the aforementioned first section of the second path and wherein it exchanges heat with the cooling fluid in the third section of the second path so as to be cooled thereby. The third path further includes a second part wherein the precooling fluid exchanges heat with the cooling fluid in the first section of the second path so as to cool the same. The precooling fluid is so selected that the heat is absorbed thereby in the second part of the third path and heat leaves the cooling fluid in the first section of the second path at small temperature differences.

5 Claims, 5 Drawing Figures

PROCESS AND ARRANGEMENT FOR COOLING FLUIDS

This is a continuation of application Ser. No. 392,810, filed Aug. 29, 1973, now abandoned.

BACKGROUND OF THE INVENTION

The invention relates generally to a process and arrangement for cooling fluids.

The invention may find particular application in so-called "Base-Load" arrangements or apparatus which are used for the liquefaction of natural gas, such liquefaction being desirable, for instance, when the natural gas is to be transported overseas. The invention may also find utility in other fields of application such as, for example, the liquefaction of helium.

In the construction of Base-Load apparatus for liquefying natural gas, the design considerations are directed to increasing the capacity of the gas train in order that an apparatus which is optimum with regard to economic factors may be obtained. The capacity of the gas trains where a single cooling circuit, having a single, if necessary, multiple-step compressor, is utilized is, however, limited by the capacity of the compressor. As a result, it is already known to additionally utilize a precooling circuit so as to divide the work of compression between two compressors. A process using such a precooling circuit is disclosed, for example, in the French Pat. Nos. 2,046,058 and 2,076,029.

Also known is a process for cooling fluids wherein an incorporated cascade circuit and a precooling circuit are used and wherein the cooling fluid in the incorporated circuit consists of a mixture which is compressed and cooled with a cooling medium. The fluid in the incorporated circuit is in the form of superheated vapor subsequent to cooling and this super-heated vapor is then partially condensed. The pressure on the resulting condensate is at least partly relieved and the condensate is vaporized, heated and returned to the compressor. The precooling fluid in the precooling circuit is also compressed and then cooled with a cooling medium and condensed. The pressure on the resulting condensate is at least partly relieved and the condensate is vaporized, heated and returned to the compressor. The precooling fluid thus obtained by evaporation and heating serves for cooling and condensing the cooling fluid in the incorporated circuit when it undergoes partial condensation.

A single component precooling fluid is utilized in the precooling circuit and this single component precooling fluid is not supercooled. It has been found that because of this it is not possible to obtain optimum utilization of the precooling fluid in the precooling circuit.

SUMMARY OF THE INVENTION

It is, accordingly, an object of the invention to provide a novel process and arrangement for cooling fluids.

More particularly, it is an object of the invention to provide a novel process for cooling fluids whereby a greater cooling efficiency is achieved.

Another object of the invention is to provide an arrangement for cooling fluids whereby a greater cooling efficiency is achieved.

In pursuance of these objects and of other which will become apparent, the invention provides a process for cooling fluids, particularly for liquefying gaseous substances, which comprises the steps of conveying a first fluid to be cooled along a first path including a portion in which the first fluid is cooled. A cooling fluid mixture is conveyed along a second path including a first section in which the cooling fluid is cooled, a second section downstream of the first section arranged in heat-exchange relationship with the aforementioned portion of the first path and wherein the cooling fluid flows countercurrent to the first fluid in this portion and cools the latter, and a third section downstream of the first section substantially thermally separated from the aforementioned first section of the second path. A precooling fluid mixture is conveyed along a third path including a first part substantially thermally separated from the aforementioned first section of the second path and arranged in heat-exchange relationship with the third section of the second path and wherein the precooling fluid flows countercurrent to the cooling fluid in the third section so as to be supercooled thereby. The third path also includes a second path downstream of the first path thereof arranged in heat-exchange relationship with the first section of the second path and wherein the precooling fluid flows countercurrent to the cooling fluid in the first section and cools the same. The precooling fluid is so selected that the heat is absorbed thereby in the second part of the third path and heat leaves the cooling fluid in the first section, at small temperature differences.

According to the invention, the precooling fluid which flows along the third path, i.e., the precooling circuit, comprises a fluid mixture. During its flow along the precooling circuit, the fluid mixture is compressed and condensed and the pressure thereon is reduced. The cooling fluid which flows along the second path, i.e. the incorporated cooling circuit arranged in cascade fashion, is also compressed therealong and cooled with a cooling medium and also undergoes a pressure reduction.

Subsequent to its condensation and prior to the pressure reduction, the fluid mixture in the precooling circuit flows through the first part thereof where it is supercooled by the cooling fluid in the incorporated cooling circuit flowing through the third section of the latter. The cooling fluid flowing through the third section of the cooling circuit has undergone a pressure reduction and is substantially completely in the vapor state and flows in a direction returning it to the compressor.

The cooling fluid in the cooling circuit is in the form of superheated vapor subsequent to being compressed and cooled with a cooling medium. In this form it flows into the first section of the cooling circuit to be cooled and partially condensed by the precooling fluid flowing in the second part of the precooling circuit. The precooling fluid flowing in the second part of the precooling circuit flows in a direction returning it to the compressor and has undergone a pressure reduction and is being heated and at least partly vaporized in the second part. The temperature of the precooling fluid upon entering the second part of the precooling circuit is about equal to or higher than the boiling point temperature thereof. The composition of the precooling fluid is so selected that the cooling curve of the cooling fluid in the first section of the cooling circuit and the heating curve of the precooling fluid in the second part of the precooling circuit (plotted in terms of temperature versus enthalpy) approximate one another.

The incorporated cascade circuit may be an open or closed cooling circuit. The cooling fluid in a closed cooling circuit may be used for liquefying gases and for like purposes. An open cooling circuit may form part of a circuit arrangement for liquefying and/or decomposing gaseous mixtures.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

The invention will be described with respect to the schematic and simplified flow diagram of FIG. 1 which represents an arrangement for liquefying gases provided with a closed, incorporated cooling circuit arranged in cascade fashion. The exemplary embodiment of FIG. 1 and the description attendant thereto are not to be construed as limiting the invention in any manner. The same applies to the temperatures, pressures and compositions given which are only estimated values presented for purposes of illustration and which, in order to obtain the optimum relationships, may require corrections such as may be obtained by appropriate computer computations. It is also noted here that the composition of the precooling fluid used in the precooling circuit is dependent upon the composition of the cooling fluid in the incorporated cooling circuit and that the optimum composition of the precooling fluid may be calculated by feeding an appropriate program into a computer.

Figure 1:
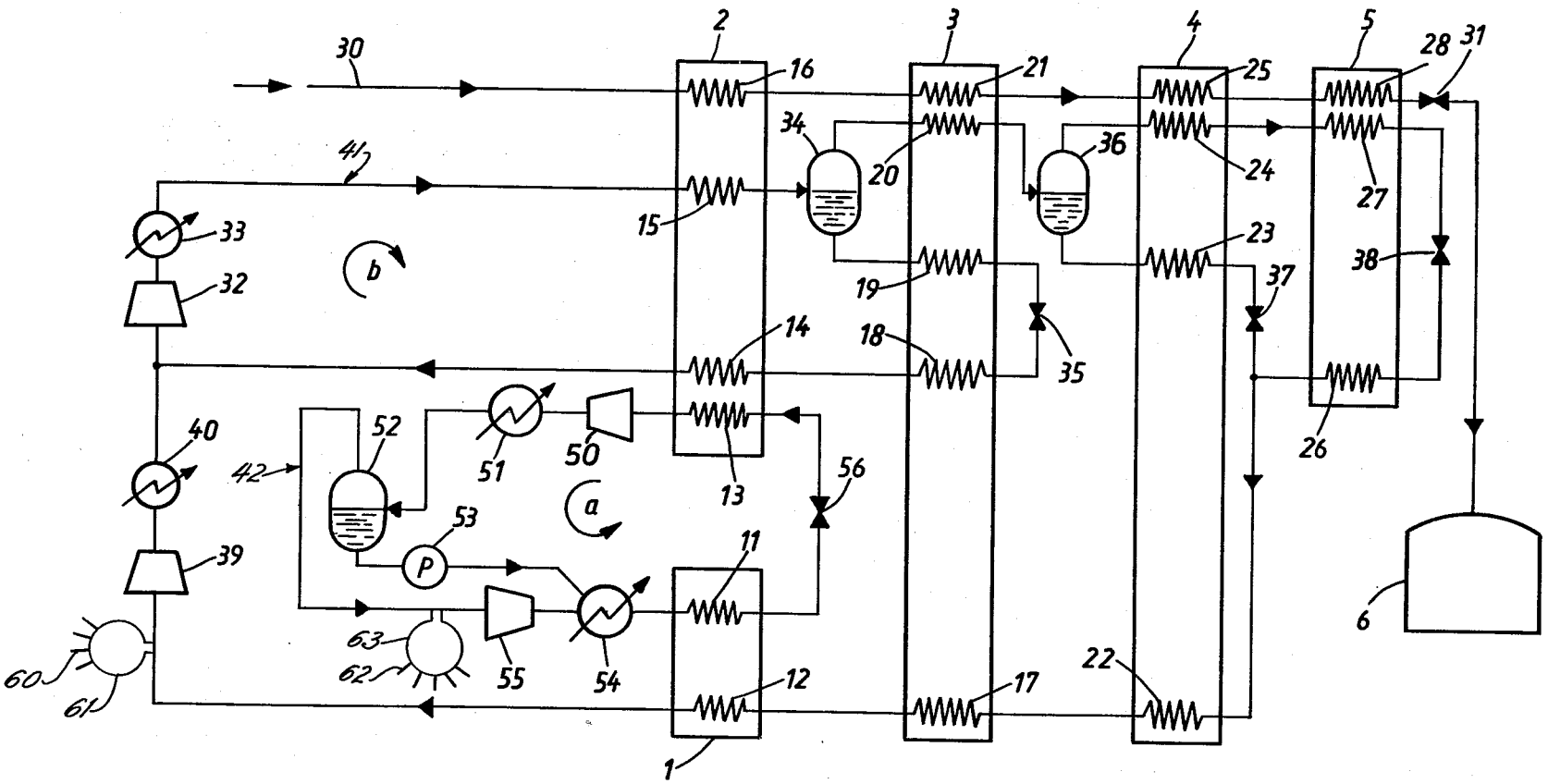
FIG. 1 is a schematic representation of an arrangement for cooling fluids according to the invention.

Referring now to FIG. 1 in detail, an arrangement in accordance with the invention includes a first heat-exchanger 1, a second heat-exchanger 2 and additional heat-exchangers 3, 4 and 5. A circuit 30 for a fluid to be cooled is provided and the conduit 30 has portions 16, 21, 25 and 28 which extend through the heat-exchangers 2, 3, 4 and 5, respectively. A fluid to be cooled is admitted into the conduit 30 as indicated by the arrow and is conveyed therealong by suitable conveying means which has not been illustrated for clarity. The fluid to be cooled is here assumed to be dried and pre-purified natural gas having a temperature of about 25°C (about 80°F), a pressure of about 40 ata (600 psia) and a composition of approximately 85 mol % methane, 10 mol % ethane and 5 mol % propane. (Note: "ata" represents atmospheres absolute and "psia" represents pounds per square inch absolute). The fluid flows successively through the portions 16, 21, 25 and 28 of the conduit 30. In the portion 16, the fluid is cooled to about −55°C (about −70°F) and is partially condensed. In the portion 21, the fluid is further cooled to about −80°C (about −110°F) and is thereby substantially entirely condensed. In passing through the portions 25 and 28, the fluid is cooled to approximately its boiling temperature at atmospheric pressure, that is, it is supercooled to about −155°C (about −250°F). The fluid then passes through a throttling or expansion valve 31 and is expanded, that is, its pressure is reduced to approximately atmospheric pressure, with substantially no vaporization losses. The fluid is then conveyed into a storage container 6 for liquefied or fluidized gas.

The arrangement of FIG. 1 further includes a precooling circuit *a* and an incorporated cascade circuit *b*. The incorporated cooling circuit *b* includes a conduit system, indicated generally at 41, defining a flow path for a cooling fluid. The cooling fluid of the incorporated cooling circuit is here assumed to be a fluid mixture containing about 15 mole % nitrogen, 50 mole % methane, 30 mole % ethane and 5 mole % propane. The cooling fluid is compressed in a compressor 32 constituting a second compression stage to about 35 ata (about 500 psia) and is cooled with cool water in an after-cooler 33. The cooling fluid is conveyed from the after-cooler 33 in the form of superheated vapor and passes through a first section 15 of the conduit 41 which extends through the heatexchanger 2. The cooling fluid in the section 15 flows in the same direction as the natural gas in the portion 16 of the conduit 30. In the section 15, the cooling fluid is cooled to about −55°C (about 70°F) and is thereby partially condensed. After leaving the section 15, the cooling fluid is conveyed into a phase-separator 34. That portion of the cooling fluid which leaves the phase-separator 34 in the form of liquid, that is, the condensate, passes through the section 19 of the conduit 41 which extends through the heat-exchanger 3 and is thereby supercooled. The cooling fluid in the section 19 flows in the same direction as the natural gas in the portion 21 of the conduit 30. After leaving the section 19, the cooling fluid passes through a throttling or expansion valve 35 and is expanded, that is, the pressure thereon is reduced to about 17 ata (about 250 psia). The expanded cooling fluid then flows through the section 18 of the conduit 41, which extends through the heat-exchanger 3 and wherein the cooling fluid flows countercurrent to the natural gas in the portion 21 of the conduit 30 and is partially vaporized, and subsequently flows through the section 14 of the conduit 41 which extends through the heat-exchanger 2 and constitutes a second section of the conduit 41. The cooling fluid in the section 14 flows countercurrent to the natural gas in the portion 16 of the conduit 30 and, in the section 14, the cooling fluid is substantially totally vaporized and is superheated. The expanded cooling fluid is then conveyed, in the form of superheated vapor, to the inlet side of the compressor 32 consituting the second compression stage.

Returning now to the phase-separator 34, that portion of the cooling fluid leaving the latter in the form of vapor passes through the section 20 of the conduit 41 which extends through the heat-exchanger 3. The cooling fluid in the section 20 flows in the same direction as the natural gas in the portion 21 of the conduit 30 and is partially condensed in the section 20. After leaving the section 20, the cooling fluid is conveyed into another phase-separator 36. That portion of the cooling fluid leaving the phase-separator 36 in the form of liquid, that is, the condensate, first flows through the section 23 of the conduit 41 which extends through the heat-exchanger 4 wherein it flows in the same direction as the natural gas in the portion 25 of the conduit 30 and is supercooled. After being conveyed from the section 23, the supercooled cooling fluid passes through a throttling or expansion valve 37 and is expanded, that is, the pressure thereon is reduced to approximately 7 ata (about 100 psia).

Directing attention once more to the phase-separator 36, that portion of the cooling fluid leaving the latter in the form of vapor flows through the section 24 of the conduit 41 which extends through the heat-exchanger 4 and then through the section 27 of the conduit 41 which extends through the heat-exchanger 5. In the sections 24 and 27, the cooling fluid flows in the same direction as the natural gas in the respective portions 25 and 28 of the conduit 30 and, during its passage through the sections 24 and 27, the cooling fluid becomes substantially completely condensed and is supercooled. After leaving the section 27, the cooling fluid passes through a throttling or expansion valve 38 and is expanded, that is, the pressure thereon is reduced to about 7 ata (about 100 psia). The cooling fluid then flows through the section 26 of the conduit 41 which extends through the heat-exchanger 5 and wherein it flows countercurrent to the natural gas in the portion 27 of the conduit 30. After passing through the section 26, the cooling fluid joins the cooling fluid which has passed through the expansion valve 37. The united stream of cooling fluid now flows through the section 22 of the conduit 41 which extends through the heat-exchanger 4 and then through the section 17 of the conduit 41 which extends through the heat-exchanger 3, the section 17 of the conduit 41 constituting a fourth section of the latter. In the sections 22 and 17, the cooling fluid flows counter-current to the natural gas in the respective portions 25 and 21 of the conduit 30. The cooling fluid next passes through the section 12 of the conduit 41 which extends through the heat-exchanger 1, the section 12 constituting a third section of the conduit 41. Upon entering the section 12, the cooling fluid is essentially completely vaporized. After leaving the section 12, the cooling fluid enters a compressor 39 which constitutes a first compression stage and is in circuit with the compressor 32 constituting the second compression stage. In the compressor 39, the cooling fluid is compressed to about 17 ata (about 250 psia). The compressed cooling fluid is then cooled with cool water in an intermediate cooler 40 and finally conveyed back to the inlet side of the compressor 32. Means for introducing the cooling fluid mixture into the cooling circuit *b* may be provided and may include, for example, inlets 60 communicating with a mixing chamber 61 which, in turn, communicates with the conduit 41. Four of the inlets 60 are shown here for purposes of illustration, one for each of the four components of the cooling fluid. Of course, the mixing chamber 61 may be eliminated and the inlets 60 may communicate directly with the conduit 41. Also, suitable conveying means for conveying the cooling fluid along the cooling circuit *b* may be provided but has not been shown for the sake of clarity. For the purposes of the present description, it is assumed that the compressor 39 constitutes the upstream end of the cooling circuit *b*.

Referring now to the precooling circuit a, which includes a conduit system indicated generally at 42, it is assumed here that the precooling fluid has a composition of substantially 10 mole % methane, 35 mole % ethane, 30 mole % propane, 20 mole % n-butane and 5 mole % n-pentane. Again, conveying means for conveying the precooling fluid along the precooling circuit a may be provided but has not been illustrated for purposes of clarity. In addition, means for introducing the precooling fluid mixture into the precooling circuit may be provided and may include, for instance, inlets 62 communicating with a mixing chamber 63 which, in turn, communicates with the conduit 42. The mixing chamber 63 may, of course, be dispensed with and the inlets 62 may communicate directly with the conduit 42. Five of the inlets 62 are illustrated here, one for each of the five components of the precooling fluid.

In the precooling circuit *a*, the precooling fluid initially enters a compressor 50 constituting a first compression stage and which, for the purpose of the present description, is assumed to constitute the upstream end of the precooling circuit *a*. Upon entering the compressor 50, the precooling fluid is substantially in the form of saturated vapor and has a pressure of approximately 7 ata (about 100 psia). The precooling fluid is compressed to about 14 ata (about 200 psia) in the compressor 50. After leaving the compressor 50, the precooling fluid is cooled with cool water in an intermediate cooler 51, removed from the latter in form of a vapor-liquid system and conveyed into a phase-separator 52. That portion of the precooling fluid leaving the phase-separator 52 in the form of liquid, that is, the condensate, is pumped with a pump 53 to a pressure of about 28 ata (about 400 psia) and is then conveyed into an after-cooler 54. On the other hand, that portion of the precooling fluid leaving the phase-separator 52 in the form of vapor into a compressor 55 consituting a second compression stage wherein it is compressed to a pressure of about 28 ata (about 400 psia) and is then likewise conveyed into the after-cooler 54. The precooling fluid is cooled with cool water in the after-cooler 54. The precooling fluid is removed from the after-cooler 54 substantially in the form of liquid which is at or near the boiling condition and enters the first part 11 of the conduit 42 which extends through the heat-exchanger 1. In the first part 11 of the conduit 42, the precooling fluid flows countercurrent to the cooling fluid flowing through the third section 12 of the incorporated cooling circuit *b*, which cooling fluid is substantially completely in the form of vapor. As a result, the precooling fluid in the first part 11 of the conduit 42 is supercooled. After leaving the first part 11, the precooling fluid of the precooling circuit a enters a throttling or expansion valve 56 and is expanded, that is, the pressure thereon is reduced to approximately 7 ata (about 100 psia). The precooling fluid is removed from the expansion valve 56 substantially in the form of liquid at or near boiling point conditions and enters the second part 13 of the conduit 42 which extends through the heat-exchanger 2. In the second part 13 of the conduit 42, the precooling fluid flows countercurrent to the natural gas in the portion 16 of the conduit 30 and to the cooling fluid flowing in the first section 15 of the incorporated cooling circuit *b*. The precooling fluid in the second part 13 of the conduit 42 is thereby substantially entirely vaporized. The precooling fluid leaves the second part 13 of the conduit 42 substantially in the form of saturated vapor and is then finally conveyed back to the inlet side of the compressor 50 constituting the first compressor stage.

It will be appreciated from the foregoing discussion that the heat-exchanger 2 may be considered as constituting a first cooling stage, the heat-exchanger 3 as constituting a second cooling stage, and so on. It may also be seen that the heat-exchangers 1 and 2 are substantially thermally separated from one another.

Figure 2:
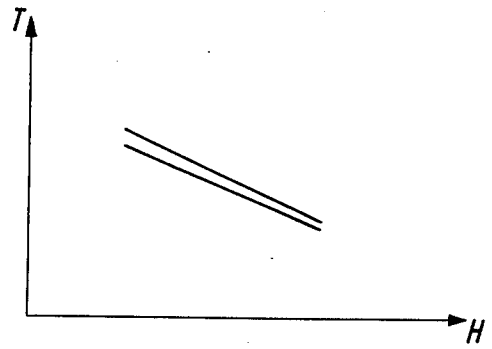
FIGS. 2–5 are plots of temperature versus enthalpy for different modifications of a process for cooling fluids according to the invention.

In accordance with the invention, it is advantageous when only small temperature differences exist in each of the heat-exchangers 1 and 2 between the fluids in the respective heat-exchangers which flow countercurrent to one another, e.g. between the precooling fluid in the first part 11 of the conduit 42 and the cooling fluid in the third section 12 of the conduit 41. The heat-exchangers 1 and 2 may, respectively, be considered as first and second counterflow heat-exchangers. In the heat-exchanger 1, liquid at a relatively high pressure is cooled to the region of supercooling and vapor at a relatively low pressure is heated to the region of superheating. The specific heats of the cooled liquid and the heated vapor are substantially constant. The cooling and heating curves are, therefore, substantially straight. Therefore, by regulation or adjustment of the counterflow characteristics in correspondence to the relationship between the specific heats, the cooling and heating curves in the heat-exchanger 1 approximate one another as schematically illustrated in FIG. 2. In this Figure, the temperature T is plotted as a function of the enthalpy H for the two cooling fluids passing through the heat-exchanger 1, i.e. the cooling fluid of the incorporated cooling circuit *b* and the precooling fluid of the precooling circuit *a*.

In the heat-exchanger 2, the specific heat of the cooling fluid in the incorporated cooling circuit *b* which is cooled in this heat-exchanger is increased. The cooling fluid enters the heat-exchanger 2 in the form of superheated vapor having a relatively low specific heat and leaves the heat-exchanger 2 in the form of a vapor-liquid system having a relatively high specific heat. If cooling of the cooling fluid occurs at a pressure which is substantially less than its critical pressure, then the increase in the specific heat is primarily due to a non-uniform or discontinuous increase in the dew point. On the other hand, when the precooling fluid in the precooling circuit a has a suitable composition, a decrease in the specific heat of the precooling fluid in the heat-exchanger 2 occurs which approximates the increase in the specific heat of the cooling fluid of the incorporated cooling circuit *b* which flows countercurrent to the precooling fluid in the heat-exchanger 2 and which is to be cooled. Therefore, by regulating or adjusting the counterflow characteristics in correspondence to the relationship between the specific heats of the cooling and precooling fluids, the cooling and heating curves in the heat-exchanger 2 will also approximate one another.

Figure 3:
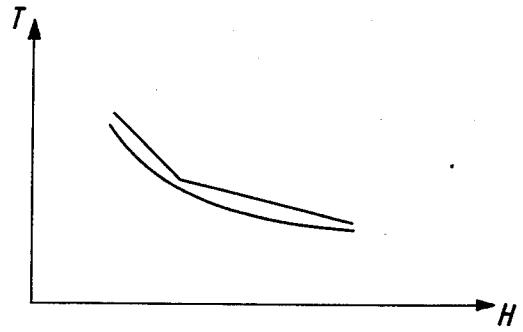

According to an advantageous modification of the invention, the precooling fluid of the precooling circuit a enters the heat-exchanger 2 at substantially the boiling point temperature thereof and leaves the same substantially in the form of saturated vapor (at the temperature of the dew point), that is, in the heat-exchanger 2 the precooling fluid passes through substantially the two-phase-region. By virtue of a suitable composition of the precooling fluid, the specific heat thereof decreases continuously with the decrease in the specific heat approximating the increase in specific heat of the cooling fluid of the incorporated cooling circuit b which flows countercurrent to the precooling fluid and is to be cooled. FIG. 3, which is similar to FIG. 2, indicates schematically the cooling and heating curves in the heat-exchanger 2 for this modification of the invention.

Figure 4:
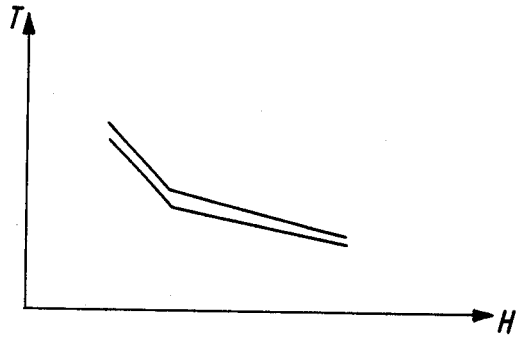

In another favorable modification of the invention, the precooling fluid of the precooling circuit a enters the heat-exchanger 2 at a temperature which is substantially higher than the boiling point temperature thereof and leaves the heat-exchanger 2 in the form of superheated vapor. The precooling fluid thus enters the heat-exchanger 2 in form of a vapor-liquid system having a relatively high specific hear, becomes substantially entirely vaporized therein, then is further heated to the region of superheated vapor and leaves the heat-exchanger 2 as superheated vapor having a relatively low specific heat. Since heating of the precooling fluid occurs at a relatively low pressure, the decrease in the specific heat is primarily due to a non-uniform or discontinuous decrease in the dew point. By suitably selecting the composition of the precooling fluid of the precooling circuit a, its specific heat in the heat-exchanger 2 during the period that it exists in a two-phase state and during the period that it exists as superheated vapor may be so chosen, as may its dew point temperature, that the decrease in the specific heat of the precooling fluid approximates the increase in the specific heat of the cooling fluid of the incorporated cooling circuit *b* which flows countercurrent to the precooling fluid and which is to be cooled. FIG. 4, which is similar to FIGS. 2 and 3, shows schematically the heating and cooling curves in the heat-exchanger 2 for this modification of the invention.

Figure 5:
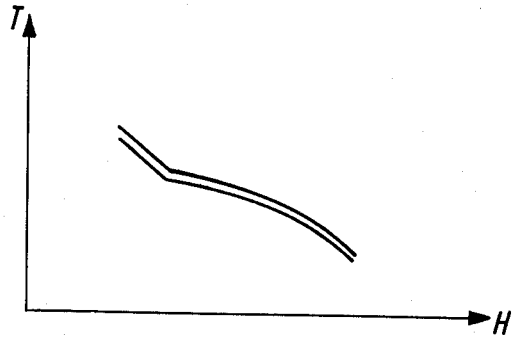

According to still another advantageous modification of the invention, the precooling fluid of the precooling circuit a enters the heat-exchanger 2 at a temperature substantially equal to its boiling point temperature and leaves the same in form of superheated vapor. Thus, the precooling fluid enters the heat-exchanger 2 substantially in the form of liquid at or near the boiling condition, becomes substantially completely vaporized and is then further heated to superheated vapor. The precooling fluid thus passes through substantially the two-phase-region in the heat-exchanger 2, in which it has a relatively high specific heat, and then passes into a condition where it exists as superheated vapor, the precooling fluid having a relatively low specific heat in the latter condition. Since heating of the precooling fluid occurs at a relatively low pressure, the decrease in the specific heat thereof is due primarily to a non-uniform or discontinuous decrease in the dew point. By suitable selection of the composition of the precooling fluid of the precooling circuit a, the specific heat of the precooling fluid in the two-phase condition, both as regards the magnitude of the specific heat and the variation thereof, the specific heat of the precooling fluid when it exists in form of superheated vapor and the dew point temperature of the precooling fluid may be so chosen that the decrease in the specific heat of the precooling fluid approximates the increase in the specific heat of the cooling fluid of the incorporated cooling circuit b which flows countercurrent to the precooling fluid and is to be cooled. FIG. 5, which is similar to FIGS. 2–4, illustrates schematically the cooling and heating curves in the heat-exchanger 2 for this modification of the invention.

In those cases where expansion of the precooling fluid in the precooling circuit a yields a fluid which is substantially in the form of liquid at or near the boiling condition, no flash evaporation occurs during the expansion so that the supercooling effect in the precooling circuit *a* is an optimum one.

According to an advantageous emodiment of the invention, all or almost all of the compressed precooling fluid in the precooling circuit *a* is condensed by means of a surrounding or enveloping cooling medium and at a pressure which is substantially equal to the pressure of the precooling fluid when it is undergoing supercooling in the heat-exchanger 1. In such a case it is further advantageous when the precooling fluid of the precooling circuit *a* is substantially in the boiling condition subsequent to condensation with the surrounding cooling medium.

In the precooling circuit *a*, a conventional process is suitable for compressing the precooling fluid when it is in a two-phase condition whereby the precooling fluid is compressed in at least two stages and is cooled in at least one intermediate cooler and one after-cooler. In the intermediate cooler, a vapor-liquid system is produced which is separated into vapor and liquid in a phase-separator. The resulting vapor is conveyed to the next compression stage whereas the resulting liquid is pumped to the end pressure of this compression stage and is conveyed into the following cooler. However, those modifications of the invention, in which the precooling fluid leaves the heat exchanger 2 in form of superheated vapor, can advantageously be designed in a manner such that this expenditure is not required.

In a favorable embodiment of the invention, the cooling circuit *b* is a closed circuit and the cooling fluid in this circuit is used for the cooling and condensation of a gaseous mixture which is in superheated condition at the ambient temperature and which is conveyed, at least in part, into the heat-exchanger 2 and is thereby cooled as well as partially condensed. This modification of the invention is particularly suitable for the liquefaction of natural gas which is relatively rich in higher boiling point components (rich natural gas) and is delivered into the cooling arrangement, i.e. the conduit 30, at an average pressure of, for example, 40 ata (600 psia). This modification of the invention is also particularly suitable for the liquefaction of natural gas which is relatively poor in higher boiling point components (lean natural gas) and which, before entering the heat-exchanger 2, is compressed to a relatively high pressure, for instance, 60 ata (900 psia).

From FIGS. 2–5, where the temperature T is plotted as the ordinate, it may be seen that a substantially small temperature difference exists between the section of the cooling circuit *b* which extends through the heat exchanger 1 and the respective part of the precooling circuit a which extends through the latter and wherein the precooling fluid flows countercurrent to the cooling fluid, and between the section of the cooling circuit *b* which extends through the heat-exchanger 2 and the respective part of the precooling circuit a which extends through the latter and wherein the precooling fluid flows counter-current to the cooling fluid. The small temperature difference, which serves as a driving force for the heat-exchange, will be seen to remain substantially small over the entire extents of the respective sections and parts of the cooling and precooling circuit *b* and *a*, that is, from the beginning to the end of each of these sections and parts.

The relationships just described are desirable as regards the efficiency of the process since it is a well known thermodynamic fact that the heat losses when two carriers are participating in a heat-exchange operation increase with an increasing temperature difference between the carriers. With an increasing temperature difference between two heat carriers there is, correspondingly, an increased expense which is required to bring one of the heat carriers to a temperature which is substantially different from that of the other heat carrier.

An approximation of the cooling and heating curves of two fluid heat carriers which are to exchange heat is favored when the fluids flow countercurrent to each other. Where the fluids flow in the same direction, an excessive temperature difference must exist between them at the beginning of that portion of their respective flow paths over which they are to exchange heat in order that a temperature difference will still exist between them at the end of this portion of their respective flow paths. Where the fluids flow countercurrent to each other, the desired relationships between the fluids may be readily obtained when both of the fluids which are to exchange heat have a substantially constant specific heat. When the specific heats of the two fluids differ, they may be compensated for by adjusting the flow rates of the fluids so as to be different.

The problems confronted by the invention are more complicated. Thus, it is advantageous to use a cooling fluid in the incorporated cooling circuit *b* which, similarly to natural gas, for example, is a mixture containing both lower and higher boiling components. Since, during heat-exchange, vaporization processes occur so that a two-phase condition is obtained where, characteristically, a higher proportion of the lower boiling components are to be found in the vapor phase than in the liquid phase, corresponding changes in the specific heat occur. The invention thus utilizes a fluid mixture in the precooling circuit a also. The precooling fluid mixture is composed of different components in such a manner that the relationships with respect to the specific heats of the precooling fluid in the precooling circuit *a*, that is, the precooling fluid in the first part 11 and the second part 13 of the precooling circuit *a*, are in correspondence to the changes in the specific heat of the cooling fluid in the incorporated cooling circuit *b*, that is, the cooling fluid in the third section 12 and the first section 15 of the incorporated cooling circuit *b*. The composition of the precooling fluid mixture may be so selected that, in both the heat-exchangers 1 and 2, both the cooling fluid and the precooling fluid undergo changes in phase or state in accordance with the heating and cooling curves of FIGS. 2–5. In other words, in advantageous manner, a small, temperature difference is maintained between the cooling and precooling fluids over the entire extents of the third and first sections 15 and 12 of the incorporated cooling circuit *b* and the respective first and second parts 11 and 13 of the precooling circuit *a*. This results in corresponding low losses and, thus, in a high efficiency of the entire process.

For processes utilizing two cooling circuits, the process according to the invention is particularly useful when it is desired for the cooling arrangement to have a high capacity so that the capacity of a single compressor havin an economically feasible size is inadequate. A process with two compressors is also advantageous when using a drive combination including a gas turbine and a steam turbine wherein the hot exhaust gases of the gas turbine are used in a steam generator, such as process leading to a high efficiency. According to the invention, small temperature differences are produced in the warm heat-exchangers of the cooling arrangement, whereas such small temperature differences could not be obtained heretofore in processes with an incorporated cascade circuit. In the precooling circuit, an optimum supercooling is achieved which is impossible to achieve in a precooling circuit with single component cooling fluid. The high efficiency of the precooling circuit and the small temperature differences in the warm heat-exchangers lead to a high overall efficiency of the process.

It will be understood that each of the elements described above, or two or more together, may also find a useful application in other types of construction and uses differing from the types described above.

While the invention has been illustrated and described as embodied in a process and arrangement for cooling fluids, it is not intended to be limited to the details shown, since various modifications and structural changes may be made without departing in any way from the spirit of the present invention, especially the cooling circuit can also be an open one.

Without further analysis, the foregoing will so fully reveal the gist of the present invention that others can by applying current knowledge readily adapt it for various applications without omitting features that, from the standpoint of prior art fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims:

1. A process for cooling fluids, particularly for liquefying gaseous substances, comprising conveying a cooling fluid mixture capable of existing in a liquid and a vapor state along a first path including a first section in which said cooling fluid is cooled, and a second section downstream of said first section which is substantially thermally separated from said first section; conveying a precooling fluid mixture capable of existing in a liquid and a vapor state along a second path including a first part which is substantially thermally separated from said first section and is arranged in heat-exchange relationship with said second section and wherein said precooling fluid flows countercurrent to said cooling fluid in said second section so as to be supercooled thereby, and said second path also including a second part downstream of said first part which is arranged in heat-exchange relationship with said first section and wherein said precooling fluid flows countercurrent to said cooling fluid in said first section and cools the same, the composition of said precooling fluid being so selected that the cooling curve of the cooling fluid in said first section and the heating curve of the precooling fluid in said second part plotted in terms of temperature versus enthalpy approximate one another; compressing said cooling fluid upstream of said first section while said cooling fluid is in its vapor state; cooling the compressed cooling fluid upstream of said first section with a surrounding cooling medium, the compressed cooling fluid being in the form of superheated vapor upon entering said first section and being partially condensed to its liquid state in said first section by the precooling fluid in said second part; separating said cooling fluid into its liquid and vapor components subsequent to said partial condensation and at least partially condensing said vapor component to its liquid state; reducing the pressure of the condensed cooling fluid upstream of said second section, the reduced pressure cooling fluid entering said second section so as to supercool the precooling fluid in said first part and being substantially entirely in its vapor state in said second section; repeating the preceding four steps with the heated and vaporized cooling fluid; compressing said precooling fluid upstream of said first part while said precooling fluid is in its vapor state; cooling the compressed precooling fluid upstream of said first part with a surrounding cooling medium so as to condense said precooling fluid to its liquid state, the condensed precooling fluid being supercooled in said first part by the cooling fluid in said second section; reducing the pressure of the supercooled precooling fluid upstream of said second part, the reduced pressure precooling fluid entering said second part at a temperature substantially equal to at least its boiling point temperature so as to cool the cooling fluid in said first section thereby being heated and vaporized to its vapor state; and repeating the preceding three steps with the heated and vaporized precooling fluid.

2. A process as defined in claim 1, wherein the temperature of said precooling fluid upon entering said second part substantially equals its boiling point temperature.

3. A process as defined in claim 1, wherein the temperature of said precooling fluid upon entering said second part is substantially higher than its boiling point temperature.

4. A process as defined in claim 1, wherein said precooling fluid is substantially in the form of saturated vapor upon leaving said second part.

5. A process as defined in claim 1, wherein said precooling fluid is substantially in the form of super-heated vapor upon leaving said second part.

* * * * *